US005490710A

United States Patent [19]

Dearing et al.

[11] Patent Number: 5,490,710

[45] Date of Patent: Feb. 13, 1996

[54] SWING ARM CHAIR

[76] Inventors: Mary K. Dearing, 806 Kennedy Rd., Braidwood, Ill. 60408-1845; Rose A. Robb, 107 W. 32nd St., Farmington, N.M. 87401

[21] Appl. No.: 283,809

[22] Filed: Aug. 1, 1994

[51] Int. Cl.[6] ..... A47B 39/00; A47B 83/02

[52] U.S. Cl. ..... 297/162; 297/173; 248/918; 248/118.5

[58] Field of Search ..... 297/155, 162, 297/173, 153, 161, 188.14; 248/447.2, 231.7, 231.5, 231.6, 118.5, 918; 108/25, 27

[56] References Cited

U.S. PATENT DOCUMENTS 3,408,104 10/1968 Raynes ..... 297/162
4,203,624 5/1980 Hopkins ..... 297/162
4,575,149 3/1986 Forestal et al. ..... 297/155
5,081,936 1/1992 Drieling ..... 108/25

*Primary Examiner*—Kenneth J. Dorner
*Assistant Examiner*—Anthony D. Barfield
*Attorney, Agent, or Firm*—Michael I. Kroll

[57] ABSTRACT

A swing arm chair comprising a component for mounting a first end of a writing tablet to one armrest on a chair that supports a person in a seated position. An element at the first end of the writing tablet is for pivoting the writing tablet longitudinally about a first axis. The writing tablet can go from a horizontal work position over the chair, to a vertical fold down storage position next to the armrest. A unit at the first end of the writing tablet is for rotating the writing tablet perpendicular about a second axis. The writing tablet can swing away, to allow the person to exit and enter the chair. A mouse pad is built into a top surface of the writing tablet at the first end thereof. The person in the chair can operate a wireless mouse on the mouse pad.

1 Claim, 2 Drawing Sheets

SWING ARM CHAIR

BACKGROUND OF THE INVENTION

1. Field of the Invention

The instant invention relates generally to office furniture and more specifically it relates to a swing arm chair.

2. Description of the Prior Art

Numerous office furniture have been provided in prior art. For example, U.S. Pat. Nos. 4,203,624 to Hopkins; 4,915,450 to Cooper and 5,056,864 to Cooper all are illustrative of such prior art. While these units may be suitable for the particular purpose to which they address, they would not be as suitable for the purposes of the present invention as heretofore described.

Hopkins, Richard B.

Writing Tablet

U.S. Pat. No. 4,023,624

A writing tablet for a chair arm is mounted by a pivot swivel block to the arm for pivotal movement about a first axis. A tablet panel support is mounted to the pivotal swivel block for pivotal movement about a second axis perpendicular to the first axis. Semicircular slots are included in the pivot swivel block and tablet panel support in registry with each other. A ball rides in the slots to limit the movement of the tablet panel support about the second axis.

Cooper, Lloyd G. B.

Work Station System

U.S. Pat. No. 4,915,450

A work station system comprising a frame substructure for holding aloft a horizontal axial shaft. A chair is coupled to the shaft by a chair coupling member. A device carriage is coupled to the shaft by a carriage coupling member. A footrest assembly is coupled to the shaft by a footrest coupling member. The chair, device, carriage and footrest assembly are coupled to the shaft to selectively pivot together about the shaft and in such a manner that a constant spatial relationship is maintained between the chair and the device carriage. The chair is swivelly connected to the chair coupling member. The frame substructure is situated substantially entirely on one side of a perpendicular bisector dropped from the shaft to a base. The frame substructure includes an axis elevating means for elevating the shaft. The axis elevating means carries a support surface which is accessible by a human operator.

Cooper, Lloyd G. B.

Work Station System

U.S. Pat. No. 5,056,864

A work station system comprising a frame substructure for holding aloft a horizontal axial shaft. A chair is coupled to the shaft by a chair coupling member. A device carriage is coupled to the shaft by a carriage coupling member. A footrest assembly is coupled to the shaft by a footrest coupling member. The chair, device, carriage and footrest assembly are coupled to the shaft to selectively pivot together about the shaft and in such a manner that a constant spatial relationship is maintained between the chair and the device carriage. The chair is swivelly connected to the chair coupling member. The frame substructure is situated substantially entirely on one side of a perpendicular bisector dropped from the shaft to a base. The frame substructure includes an axis elevating means for elevating the shaft. The axis elevating means carries a support surface which is accessible by a human operator.

None of the preceding patents teaches the combination of a writing tablet incorporating a recessed mouse pad and which is freely rotatable in a horizontal plane and hinged to rotate into a stored position.

SUMMARY OF THE INVENTION

A primary object of the present invention is to provide a swing arm chair that will overcome the shortcomings of the prior art devices.

Another object is to provide a swing arm chair, in which a mouse pad is built into a writing tablet that can swing away and fold down and can be installed onto the right or left armrest of the chair.

An additional object is to provide a swing arm chair, in which the mouse pad is always within an arms length, so as to put less strain on the arms and shoulders that are extended while a person works or plays with a computer.

A further object is to provide a swing arm chair that is simple and easy to use.

A still further object is to provide a swing arm chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
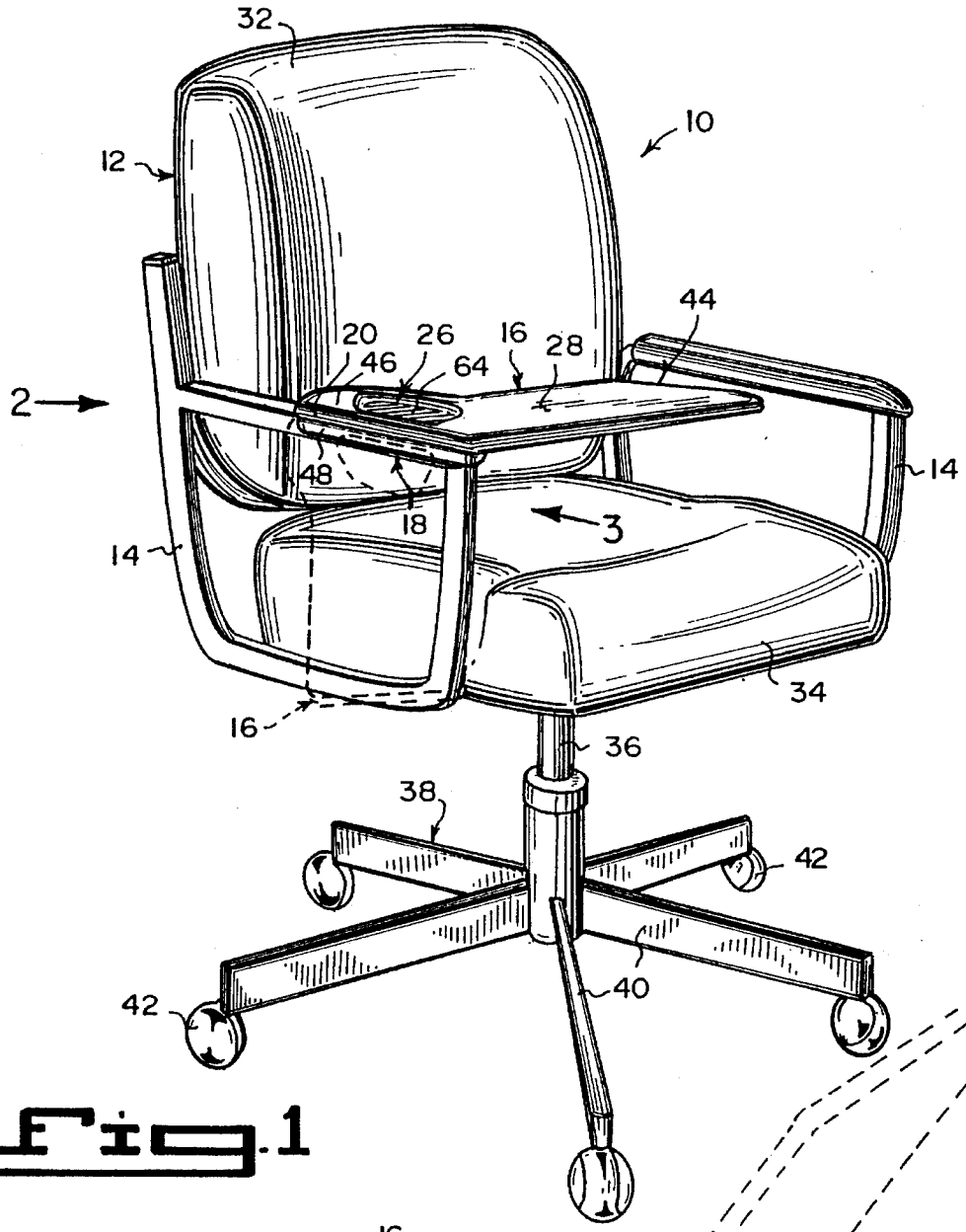
FIG. 1 is a front perspective view of the instant invention.
Figure 2:
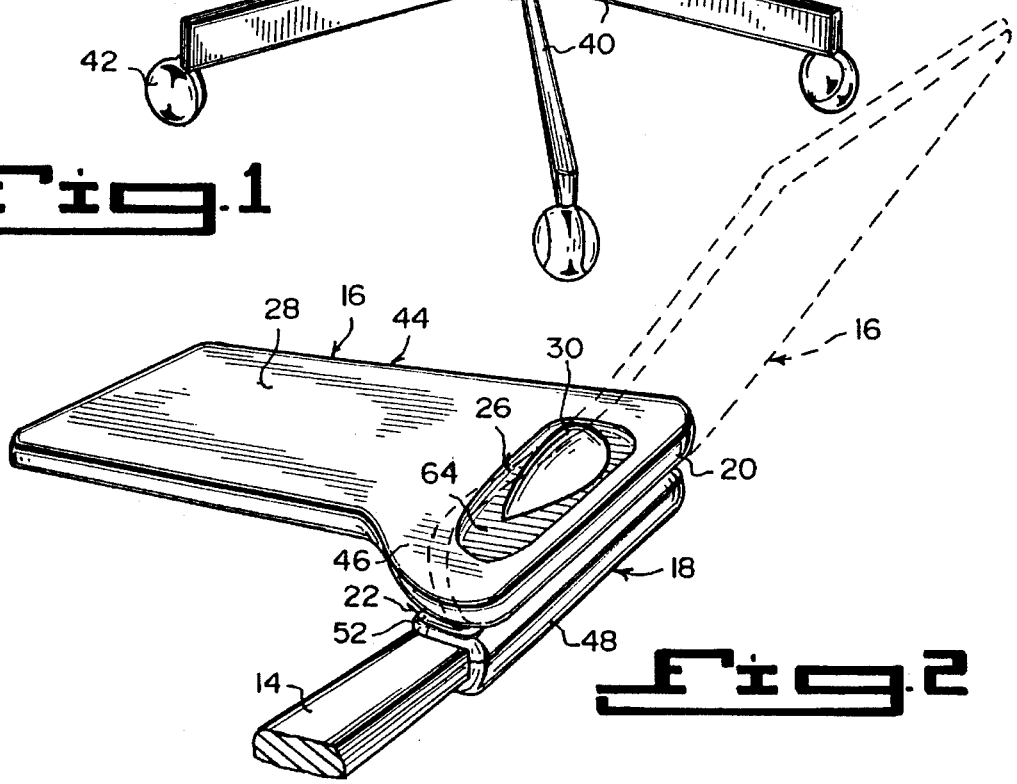
FIG. 2 is a rear perspective view of a portion thereof taken in the direction of arrow 2 in FIG. 1.
Figure 3:
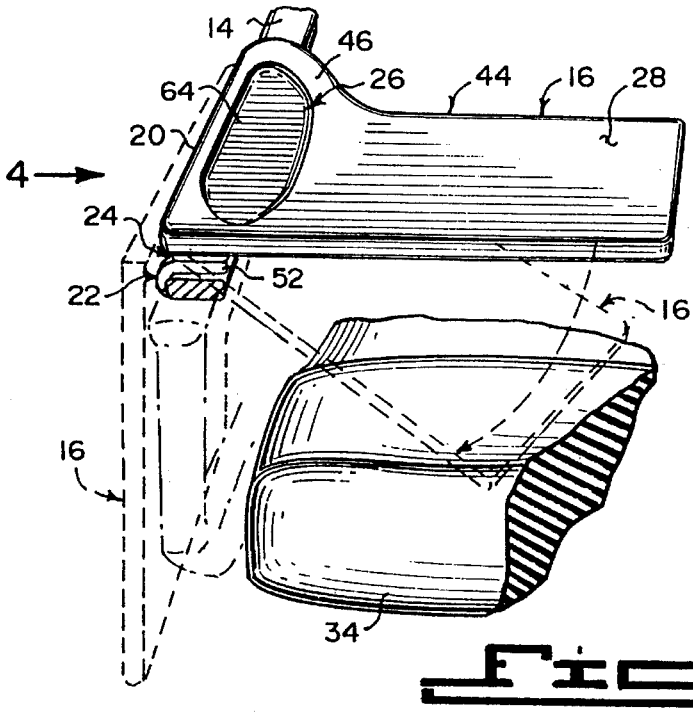
FIG. 3 is a front perspective view taken in the direction of arrow 3 in FIG. 1, with parts broken away.
Figure 4:
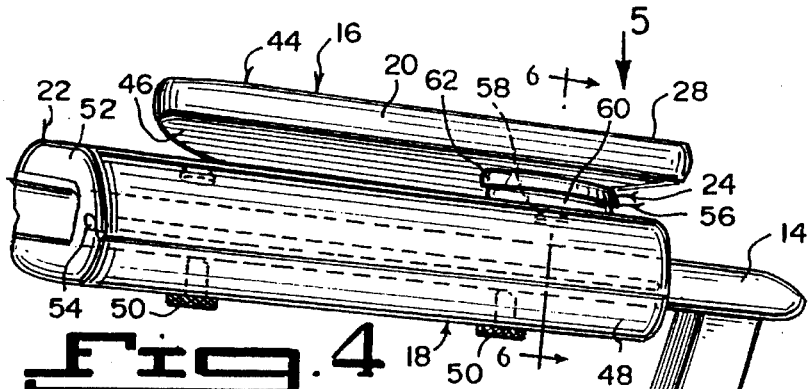
FIG. 4 is a side perspective view taken in the direction of arrow 4 in FIG. 3.
Figure 5:
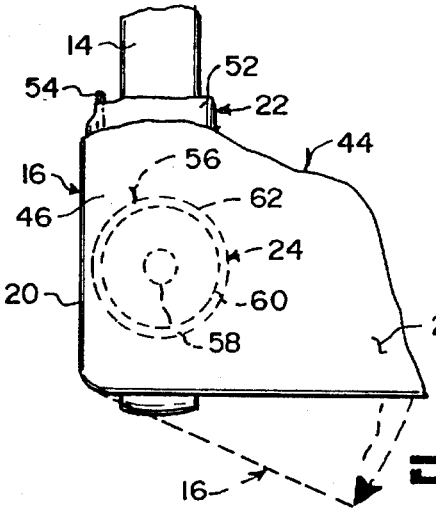
FIG. 5 is a top view taken in the direction of arrow 5 in FIG. 4 with parts broken away.
Figure 6:
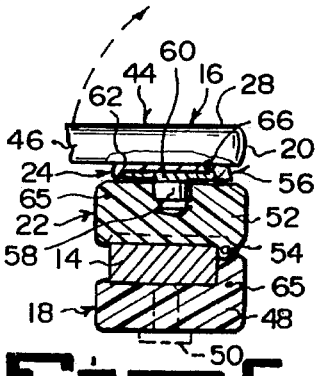
FIG. 6 is a cross sectional view taken along line 6—6 in FIG. 4.

Turning now descriptively to the drawings, in which similar reference characters denote similar elements throughout the several views, FIGS. 1 through 6 illustrate a swing arm chair 10 comprising a chair 12 for supporting a person in a seated position. A pair of armrests 14 are on the sides of the chair 12. A writing tablet 16 is provided. A component 18 is for mounting a first end 20 of the writing tablet 16 to one armrest 14. An element 22 at the first end 20 of the writing tablet 16 is for pivoting the writing tablet 16 longitudinally about a first axis. The writing tablet 16 can go from a horizontal work position over the chair 12, to a vertical fold down storage position next to the armrest 14, as shown in phantom in FIGS. 1 and 3. A unit 24 at the first end 20 of the writing tablet 16 is for rotating the writing tablet 16 perpendicular about a second axis. The writing tablet 16 can swing away, to allow the person to exit and enter the chair 12. A mouse pad 26 is built into a top surface 28 of the writing tablet 16 at the first end 20 thereof. The person in the chair 12 can operate a wireless mouse 30, shown in FIG. 2 on the mouse pad 26.

The chair 12 includes a padded backrest 32 and a swivel cushioned seat 34. A pedestal column 36 extends downwardly from the center of the seat 34. A base 38 is for supporting the pedestal column 36 in an upright position. The base 38 has a plurality of radial prongs 40 thereabout. A plurality of casters 42 are provided. Each caster 42 is affixed to a distal free end of one prong 40 of the base 38, so that the chair 12 will be mobile to be moved about from place to place.

The writing tablet 16 is a flat rectangular member 44 having an enlarged portion 46 at the first end 20, so as to accommodate for the mouse pad 26 that is built into the top surface 28.

The mounting component 18 consists of an elongated C-shaped clamp 48 to fit onto the armrest 14. A pair of setscrews 50 are spaced apart and extend upwardly through the underside of the clamp 48 against the armrest 14, to hold the clamp 48 stationary thereto.

The pivoting element contains an elongated rectangular plate 52 sized to fit onto the top side of the clamp 48. A pin 54 extends through one side of the plate 52 and the clamp 48, so as to couple the plate 52 onto the clamp 48 and permit pivotal movement of the plate 52.

The rotating unit 24 is a lazy Susan assembly 56 between the first end 20 of the writing tablet 16 and the plate 52, to permit rotative movement of the writing tablet 16 with respect to the plate 52.

The lazy Susan assembly 56 includes a shank 58 to extend into and be retained in a stationary position with the plate 52. A first disc 60 is affixed at its center onto the shank 58. A second disc 62 is rotatively attached onto the first disc 60 and is secured to the underside adjacent the first end 20 of the writing tablet 16.

The mouse pad 26 is a flat panel 64 recessed into the top surface 28 of the writing tablet 16, to allow a ball of the wireless mouse 30 to roll thereupon.

The clamp 48 and the plate 52 are fabricated out of a strong durable plastic material 64. The lazy Susan assembly 56 is fabricated out of a strong durable metal material 66.

LIST OF REFERENCE NUMBERS

10 swing arm chair
12 chair
14 armrest
16 writing tablet
18 mounting component
20 first end of 16
22 pivoting element
24 rotating unit
26 mouse pad
28 top surface of 16
30 wireless mouse
32 padded backrest
34 swivel cushioned seat
36 pedestal column
38 base
40 radial prong on 38
42 caster on 40
44 flat rectangular member for 16
46 enlarged portion of 44
48 elongated C-shaped clamp
50 setscrew
52 elongated rectangular plate
54 pin
56 lazy Susan assembly for 24
58 shank in 52
60 first disc on 58
62 second disc on 60
64 strong durable plastic material for 48 and 52
66 strong durable metal material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A swing arm chair comprising:

a) a chair for supporting a person in a seated position, said chair comprising a padded backrest a swivel cushioned seat, a pedestal column extending downwardly from the center of said seat, and a base for supporting said pedestal column in an upright position;

b) a pair of armrests on the sides of said chair;

c) a flat, generally rectangular writing tablet having an enlarged area at one end thereof, said enlarged area having an elongated, recessed mouse pad to accommodate a wireless mouse;

d) means comprising an elongated C-shaped clamp attached to said arm rest for mounting a first end of said writing tablet to one said armrest, said first end being at the end having said enlarged area, said C-shaped clamp being attached to said arm rest using a pair of set screws;

e) said C-shaped clamp including means at the first end of said writing tablet, for pivoting said writing tablet longitudinally about a first axis, so that said writing tablet can go from a horizontal work position over said chair, to a vertical fold down storage position next to said armrest; and f) swivel assembly means at the first end of said writing tablet for permitting said writing tablet to rotate 360 degrees in a horizontal plane to allow the person to exit and enter said chair.

* * * * *